US009165462B2

(12) United States Patent
Ma

(10) Patent No.: US 9,165,462 B2
(45) Date of Patent: Oct. 20, 2015

(54) SYSTEM AND METHOD FOR TRAFFIC CONTROL

(75) Inventor: Weiguo Ma, Beijing (CN)

(73) Assignee: CHINA ACADEMY OF TELECOMMUNICATIONS TECHNOLOGY, Beijing (CN)

( * ) Notice: Subject to any disclaimer, the term of this patent is extended or adjusted under 35 U.S.C. 154(b) by 336 days.

(21) Appl. No.: 13/701,822

(22) PCT Filed: Nov. 3, 2011

(86) PCT No.: PCT/CN2011/081736

§ 371 (c)(1),
(2), (4) Date: Dec. 3, 2012

(87) PCT Pub. No.: WO2012/071965

PCT Pub. Date: Jun. 7, 2012

(65) Prior Publication Data

US 2013/0069799 A1 Mar. 21, 2013

(30) Foreign Application Priority Data

Dec. 2, 2010 (CN) ..... 2010 1 0571045

(51) Int. Cl.

*G08G 1/095* (2006.01)
*G08G 1/07* (2006.01)
*G08G 1/005* (2006.01)

(52) U.S. Cl.

CPC . *G08G 1/07* (2013.01); *G08G 1/005* (2013.01)

(58) Field of Classification Search

CPC ..... G08G 1/07; G08G 1/005
USPC ..... 340/901, 902, 903, 904, 905, 933
See application file for complete search history.

(56) References Cited

U.S. PATENT DOCUMENTS 6,597,293 B1 7/2003 Harrison
2007/0274158 A1* 11/2007 Agam et al. ..... 367/96
2009/0146841 A1 6/2009 Basson et al.

FOREIGN PATENT DOCUMENTS

CN 101221696 A 7/2008
CN 101587649 A 11/2009
EP 2 211 321 A1 7/2010
JP 2001-236594 A 8/2001

OTHER PUBLICATIONS

Examination Report in EP 11845271.3, mailed Sep. 12, 2013.
International Search Report received in PCT/CN2011/081736 dated Feb. 9, 2012.

* cited by examiner

*Primary Examiner* — Daryl Pope
(74) *Attorney, Agent, or Firm* — Gilberto M. Villacorta; Foley & Lardner LLP

(57) ABSTRACT

A system and a method for controlling traffic, the method comprising: when a sensing terminal sends a wireless signal, the intensity of the wireless signal sent by the sensing terminal is determined by wireless sensor nodes (101) located on both sides of a road, and the determined intensity is passed to an information processing module (102); the information processing module (102); the information processing module (102) controls the state of a traffic light according to the change in the intensity determined by the wireless sensor nodes (101). By means of the present application, the state of pedestrians crossing the road can be automatically determined, and the traffic light can be automatically adjusted, so as to ensure the safety of pedestrians effectively.

16 Claims, 3 Drawing Sheets

SYSTEM AND METHOD FOR TRAFFIC CONTROL

The present application is a US National Stage of International Application No. PCT/CN2011/081736, filed 3 Nov. 2011, designating the United States, and claiming the benefit of Chinese Patent Application No. 201010571045.6, filed with the Chinese Patent Office on Dec. 2, 2010 and entitled "System and method for traffic control", which is hereby incorporated by reference in its entirety.

FIELD OF THE INVENTION

The present invention relates to an automatic control technology and particularly to a system and method for traffic control.

BACKGROUND OF THE INVENTION

Pedestrian passing time is typically set at a fixed value in a traffic control system for a pedestrian crossing in the prior art.

The passing time for a slower pedestrian, e.g., an elderly man or woman, a person with a poor self-control ability (e.g., a younger child), etc., may exceed the preset fixed time. However the existing traffic signal lamp control system can not judge whether there is a pedestrian passing by, thus possibly in such a phenomenon that a pedestrian may be trapped at the middle of a road and fail to pass smoothly when traffic signal lamps change in color during passage of the pedestrian through a crossing.

Furthermore a child may judge a change in traffic signal lamp inaccurately and pass slowly, so numerous hidden dangers may result from the solution with a fixed value at a crosswalk on a road nearby elementary and middle schools.

SUMMARY OF THE INVENTION

A technical problem to be addressed by the invention is to provide a traffic control system and method so as to improve the safety of road traffic.

There is provided in an embodiment of the invention a traffic control system including:

wireless sensor nodes, respectively on both sides of a road, configured to determine the strengths of a wireless signal transmitted from a sensor terminal when the sensor terminal transmits the wireless signal and to notify an information processing module of the determined strengths; and the information processing module configured to control the status of traffic signal lamps according to the changes in the strengths determined by the wireless sensor nodes.

There is further provided in an embodiment of the invention a control method of the foregoing traffic control system, which includes the steps of:

determining, by wireless sensor nodes respectively on both sides of a road, the strengths of a wireless signal transmitted from a sensor terminal when the sensor terminal transmits the wireless signal and notifying an information processing module of the determined strengths; and controlling, by the information processing module, the status of traffic signal lamps according to the changes in the strengths determined by the wireless sensor nodes.

There is provided in an embodiment of the invention a traffic control method including:

determining respectively on both sides of a road the strengths of a wireless signal transmitted from a sensor terminal when the sensor terminal transmits the wireless signal; and controlling the status of traffic signal lamps according to the changes in the determined strengths.

There is provided in an embodiment of the invention a traffic control apparatus including:

an obtaining module configured to determine respectively on both sides of a road the strengths of a wireless signal transmitted from a sensor terminal when the sensor terminal transmits the wireless signal; and the controlling module configured to control the status of traffic signal lamps according to the changes in the determined strengths.

Advantageous effects of the invention are as follows:

In an implementation of the invention, wireless sensor nodes respectively on both sides of a road can notify timely an information processing module of the strengths of a wireless signal of a sensor terminal, and the information processing module can control the status of traffic signal lamps according to the changes in strength of the sensor terminal, so that a passage status of a pedestrian passing a road can be determined automatically and the signal lamps can be adjusted automatically to thereby ensure effectively the safety of the pedestrian.

DETAILED DESCRIPTION OF THE EMBODIMENTS

A technical solution according to an embodiment of the invention relates to control on traffic signal lamps, where a sensor terminal carried by a pedestrian passing a crossing is identified and analyzed through a low-power short-range wireless communication device to analyze a behavior of the pedestrian passing the crossing and to control a duration of traffic signal lamps flexibly to thereby ensure smooth passage of the pedestrian through the crossing, thus improving the safety on the road and protecting the pedestrian for traffic safety. Embodiments of the invention will be described below with reference to the drawings.

Figure 1:
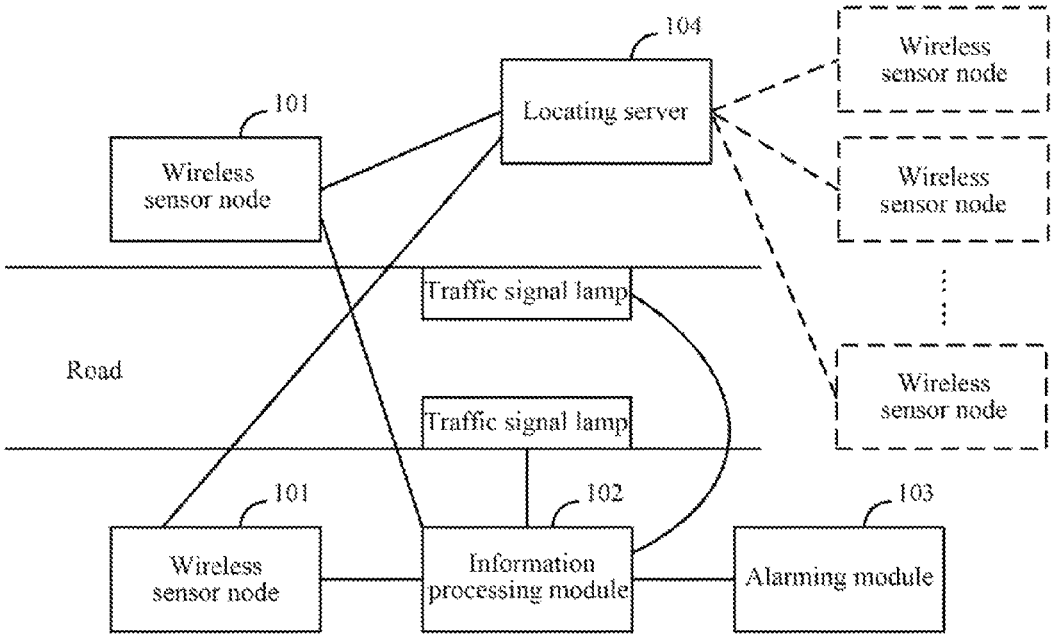
FIG. 1 is a schematic structural diagram of a traffic control system according to an embodiment of the invention.

FIG. 1 is a schematic structural diagram of a traffic control system, and as illustrated, the system can include:

Two wireless sensor nodes 101 respectively on both sides of a road are configured to determine the strengths of a wireless signal transmitted from a sensor terminal upon obtaining the wireless signal transmitted from the sensor terminal and to notify an information processing module of the determined strengths; and The information processing module 102 is configured to determine changes in strength of the wireless signal according to the strengths of the wireless signal determined by the wireless sensor nodes 101 and to control the status of traffic signal lamps according to the changes in strength.

In an implementation, the traffic control system can be constituted of the information processing module and the wireless sensor nodes and can cooperate with the sensor terminal to control the traffic signal lamps in order to improve the safety of passing a crosswalk on the road.

In a specific implementation, when the wireless sensor nodes notify the information processing module of the determined strengths, there may be a number of sensor terminals because typically a number of pedestrians are at the crossing, and in order to identify the respective sensor terminals, the information processing module can be notified of the identifiers of the sensor terminals along with the strengths for identification by the information processing module. Of course, those skilled in the art can readily appreciate that the sensor terminals can be identified easily, and also they can be identified in a specific way other than by their "identifiers" so long as the different sensor terminals can be identified, for example, by their different frequencies, and an implementation of the invention will not be limited particularly in terms of how to identify the sensor terminals.

Figure 2:
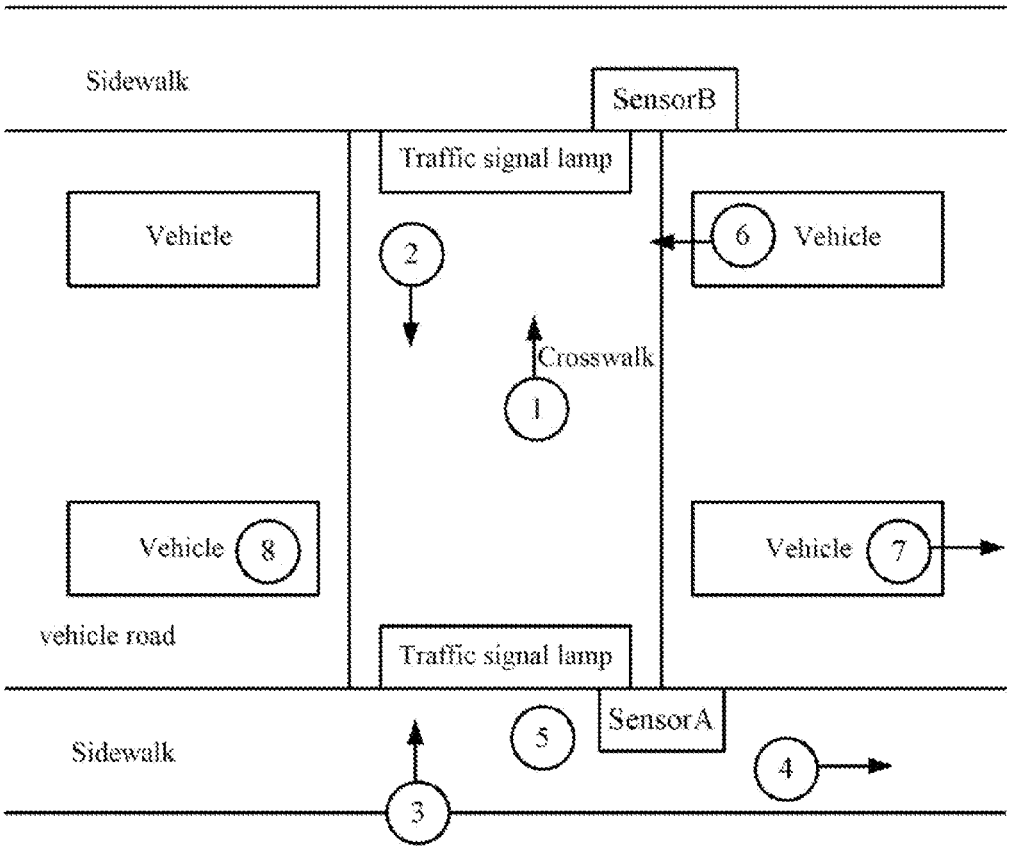
FIG. 2 is a schematic diagram of an environment in which the traffic control system is employed according to an embodiment of the invention.

FIG. 2 is a schematic diagram of an environment in which the traffic control system is employed, and as illustrated, the sensor nodes with wireless communication capability, illustrated as a sensor A and a sensor B, can be installed respectively on traffic signal lamps on both sides of the road in a specific implementation. A user carries a terminal that can be sensed by the wireless sensors (i.e., the sensor terminal). The wireless sensor nodes can transmit received information relevant to the sensor terminal to the information processing module.

In an implementation of the sensor terminal, the sensor terminals can be distributed to a specific group of pedestrians (e.g., children and/or elderly men or women), and preferably a sensing distance is above the distance between two wireless sensor nodes on both sides of the road.

The wireless sensor nodes can measure the strengths of a signal of the sensor terminal and their changes.

The sensor A and the sensor B record the strengths of signals transmitted from all the sensor terminals in a communication range and transmit the strengths of the signals to the information processing module, which performs an analysis process on the received data and derives real-time behavior status of the sensor terminals around the crossing and further controls the traffic signal lamp system according to a current status of the traffic signal lamps to thereby improve the efficiency and safety of passing the crossing.

In an implementation, the information processing module can further be configured to control the status of the traffic signal lamps in any one or combination of the following ways:

If the changes in strength of a wireless signal of at least one sensor terminal meet the condition that the strength determined by one of the wireless sensor nodes on both sides of the road decreases and the strength determined by the other wireless sensor node increases, then the status of the traffic signal lamps is controlled to let the pedestrian pass; otherwise, the status of the traffic signal lamps is controlled according to a setting of the traffic signal lamps.

Stated otherwise, when there are a plurality of sensor terminals around the crossing, if the strength of a signal of any one of sensor terminals decreases with respect to one of the wireless sensor nodes on both sides of the road and increases with respect to the other wireless sensor node, then the status of the traffic signal lamps is controlled to let the pedestrian pass; otherwise, the status of the traffic signal lamps is controlled according to the setting of the traffic signal lamps.

When the status of the traffic signal lamps is controlled according to the setting of the traffic signal lamps, the changes in strength of a wireless signal of any sensor terminal shall meets one of the following conditions:

That the strength determined by one of the wireless sensor nodes on both sides of the road decreases and the strength determined by the other wireless sensor node decreases;

That the strength determined by one of the wireless sensor nodes on both sides of the road increases and the strength determined by the other wireless sensor node increases; and That the strength determined by one of the wireless sensor nodes on both sides of the road is stable and the strength determined by the other wireless sensor node is stable.

Control of the status of the traffic signal lamp will be described below taking FIG. 2 as an example.

FIG. 2 further illustrates a vehicle road and a sidewalk next to the road. The sensor A and the sensor B are installed respectively on the traffic signal lamps on both sides of the road. Users are represented by circles with numerals and carry sensor terminals, made of intelligent chips, which can be identified by the sensors; and passengers in automobiles as illustrated carry sensor terminals and are numbered with the illustrated numerals, and a behavior of the automobiles can be determined from the sensor terminals carried by the passengers.

As can be appreciated in a specific implementation, wireless sensors are installed on both sides of a vehicle road of a crosswalk nearby elementary and middle schools. The traffic control system is equipped to process data and to control the traffic signal lamps. Students of middle and elementary schools are equipped with corresponding sensor terminals, and the traffic control system is enabled automatically to control the traffic signal lamps during peak hours of arriving at or departing from the schools or throughout a day.

Eight user behavior patterns are listed in Table below together with characteristics of the strength of a signal received by the sensors in the respective patterns numbered consistently with the users in FIG. 2.

| No. | Sensor terminal Location | Pedestrian status | Change in strength of sensor A signal | Change in strength of sensor B signal | Comment |
|---|---|---|---|---|---|
| 1 | On the crosswalk | Crossing the road (A->B) | Decrease | Increase | The pedestrian is passing and the traffic signal lamps shall be kept to prohibit any vehicle from passing. |
| 2 | On the crosswalk | Crossing the road (B->A) | Increase | Decrease | |
| 3 | On the sidewalk next to road | Approaching the crossing | Increase | Increase | The pedestrian has not entered or has passed successfully the |
| 4 | On the sidewalk next to the road | Leaving the crossing | Decrease | Decrease | |

-continued

| No. | Sensor terminal Location | Pedestrian status | Change in strength of sensor A signal | Change in strength of sensor B signal | Comment |
|---|---|---|---|---|---|
| 5 | On the sidewalk next to the road | Waiting at rest | Stable | Stable | crosswalk and the traffic signal lamps can be altered normally. |
| 6 | In the vehicle on the road | Approaching the crosswalk | Increase | Increase | An interference signal originates |
| 7 | In the vehicle on the road | Leaving crosswalk | Decrease | Decrease | from the sensor terminal carried |
| 8 | In the vehicle on the road | Waiting at rest | Stable | Stable | by the passenger in the vehicle. |

For the user passing the crosswalk, the strength of the signal of the sensor terminal carried by the user increases in one of the two sensors and decreases in the other one, and this is very unique among the foregoing various scenarios. This characteristic can be used as a criterion to distinguish the user passing the crosswalk to thereby control the traffic signal lamps. Specifically the status of the traffic signal lamps is controlled at this time to let the pedestrian pass. For example, if the lamps are in red and the pedestrian is at the middle of the road at this time, then the lamps can be controlled to turn green; and if the lamps are in green, then the lamps can simply be lengthen in duration. On the contrary, if this scenario does not happen, then the status of the traffic signal lamps can simply be controlled according to the setting of the traffic signal lamps. For example, if the lamps are originally set to turn red, then the lamps can simply turn red according to the setting because there is no pedestrian passing by.

In an implementation, the system can further include:

An alarming module 103 configured to transmit a rapid passing alarm when the strength determined by one of the wireless sensor nodes decreases and the strength determined by the other wireless sensor node increases and the status of the traffic signal lamps to let a pedestrian pass.

Specifically if the information processing module determines that there is still a pedestrian carrying the sensor terminal and passing the vehicle road while a preset fixed passing time period is expiring during passing of the pedestrian, then the passing time period can be controlled to be lengthen, that is, the status of the traffic signal lamps can be controlled to let the pedestrian pass while transmitting an audible or optical alarm signal or combination thereof to urge the pedestrian to pass rapidly. The information processing module will not control the system to prohibit any pedestrian from walking until all the pedestrians carrying the sensor terminals pass the vehicle road safely. Also a rapid passing alarm can be transmitted and a wait time of the vehicles can be lengthened as appropriate when there is still a pedestrian passing the crosswalk while the duration of the lamps in green is expiring. In particular practice, an alarm can be set as needed upon determining that there is a pedestrian passing.

In an implementation, the system can further include:

A locating server 104 configured to determine location information of respective sensor terminals according to the received strengths and reception times of the respective sensor terminals and the wireless sensor nodes determining the sensor terminals.

The wireless sensor nodes can further be configured to notify the locating server of determined sensor terminals and their strengths.

Specifically if wireless sensor nodes are extensively deployed the traffic crossing and the locating server is added after the relevant traffic control system is networked, then the locating server can provide quasi real-time locating information of the sensor terminals by recording passing status and time of the sensor terminals and other information.

Correspondingly there is further provided in an embodiment of the invention a method of using the foregoing traffic control system, which will be described below.

Figure 3:
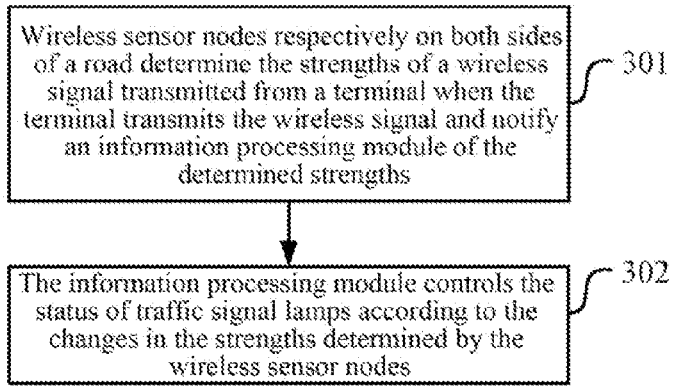
FIG. 3 is a schematic flow chart of performing a control method of a traffic control system is employed according to an embodiment of the invention.

FIG. 3 is a schematic flow chart of performing a control method of a traffic control system, and as illustrated, the method can include the following steps:

In the step 301, wireless sensor nodes respectively on both sides of a road determine the strengths of a wireless signal transmitted from a sensor terminal when the sensor terminal transmits the wireless signal and notify an information processing module of the determined strengths.

In the step 302, the information processing module controls the status of traffic signal lamps according to the changes in the strengths determined by the wireless sensor nodes.

In an implementation, the information processing module can control the status of the traffic signal lamps in any one or combination of the following ways for the change in strength of a wireless signal of a sensor terminal:

When the strength determined by one of the wireless sensor nodes on both sides of the road decreases and the strength determined by the other wireless sensor node increases, the information processing module controls the status of the traffic signal lamps to let a pedestrian pass;

When the strength determined by one of the wireless sensor nodes on both sides of the road decreases and the strength determined by the other wireless sensor node decreases, the information processing module controls the status of the traffic signal lamps according to a setting of the traffic signal lamps;

When the strength determined by one of the wireless sensor nodes on both sides of the road increases and the strength determined by the other wireless sensor node increases, the information processing module controls the status of the traffic signal lamps according to the setting of the traffic signal lamps; and When the strength determined by one of the wireless sensor nodes on both sides of the road is stable and the strength determined by the other wireless sensor node is stable, the information processing module controls the status of the traffic signal lamps according to the setting of the traffic signal lamps.

In an implementation, the method can further include:

When the strength determined by one of the wireless sensor nodes decreases and the strength determined by the other wireless sensor node increases and the status of the traffic signal lamps is controlled to let the pedestrian pass, an alarming module transmits a rapid passing alarm.

In an implementation, the method can further include:

The wireless sensor nodes notify a locating server of determined sensor terminals and their strengths; and The locating server determines location information of the respective sensor terminals according to received strengths and reception times of the respective sensor terminals and the wireless sensor nodes determining the sensor terminals.

In a specific implementation, the locating server can readily know the change in location of each sensor terminal according to the change in strength of the respective sensor terminals in a temporal order in combination with the identifiers of the respective sensor terminals.

Based upon the same inventive idea, there is further provided in an embodiment of the invention a traffic control method and a traffic control apparatus, and since the traffic control method and the traffic control apparatus address the problem under a similar principle to the traffic control system and the control method thereof, reference can be made to the implementations of the traffic control system and the control method thereof for implementations of the traffic control method and the traffic control apparatus, a repeated description of which will be omitted here.

Figure 4:
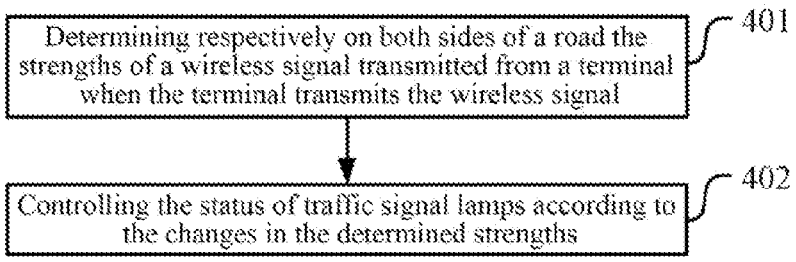
FIG. 4 is a schematic flow chart of performing a traffic control method according to an embodiment of the invention.

FIG. 4 is a schematic flow chart of performing a traffic control method, and as illustrated, the method can include the following steps:

The step 401 is to determine respectively on both sides of a road the strengths of a wireless signal transmitted from a sensor terminal when the sensor terminal transmits the wireless signal; and The step 402 is to control the status of traffic signal lamps according to the changes in the determined strengths.

In an implementation, the status of the traffic signal lamps can be controlled according to the changes in the determined strengths in any one or combination of the following ways for the change in strength of a wireless signal of a sensor terminal:

When the strength determined on one of the sides of the road decreases and the strength determined on the other side increases, the status of the traffic signal lamps is controlled to let a pedestrian pass;

When the strength determined on one of the sides of the road decreases and the strength determined on the other side decreases, the status of the traffic signal lamps is controlled according to a setting of the traffic signal lamps;

When the strength determined on one of the sides of the road increases and the strength determined on the other side increases, the status of the traffic signal lamps is controlled according to the setting of the traffic signal lamps; and When the strength determined on one of the sides of the road is stable and the strength determined on the other side is stable, the status of the traffic signal lamps is controlled according to the setting of the traffic signal lamps.

In an implementation, when the strength determined on one of the sides of the road decreases and the strength determined on the other side increases and the status of the traffic signal lamps is controlled to let the pedestrian pass, the method can further include:

A rapid passing alarm is transmitted.

In an implementation, the method can further include:

Location information of respective sensor terminals is determined according to strengths and times of the respective sensor terminals and locations where the wireless signal is received.

Figure 5:
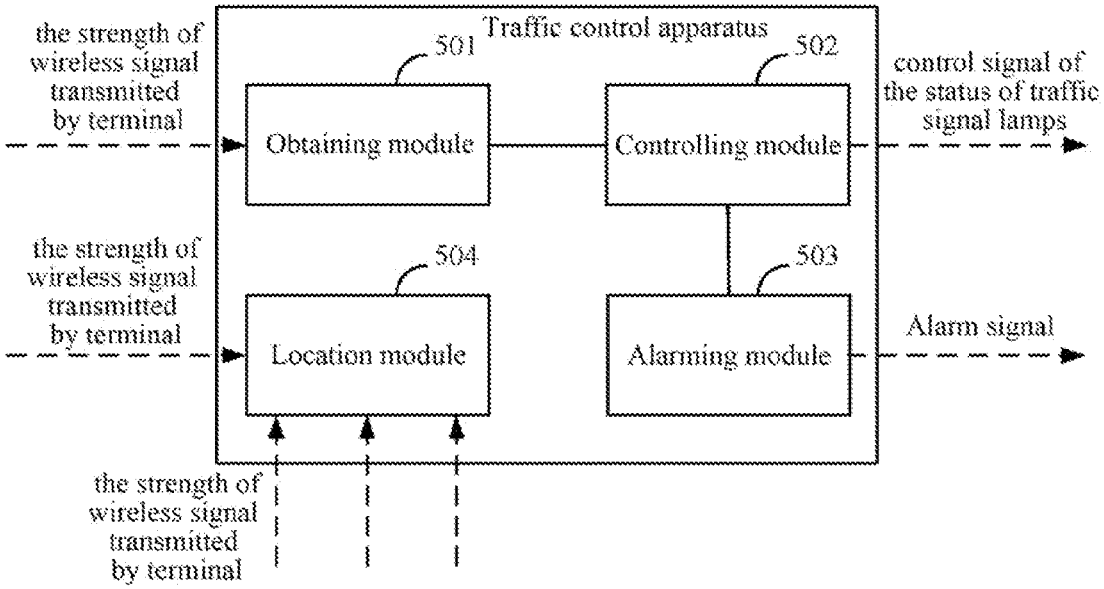
FIG. 5 is a schematic structural diagram of a traffic control apparatus according to an embodiment of the invention.

FIG. 5 is a schematic structural diagram of a traffic control apparatus, and as illustrated, the apparatus can include:

An obtaining module 501 configured to determine respectively on both sides of a road the strengths of a wireless signal transmitted from a sensor terminal when the sensor terminal transmits the wireless signal; and The controlling module 502 configured to control the status of traffic signal lamps according to the changes in the determined strengths.

In an implementation, the controlling module can further be configured to control the status of the traffic signal lamps according to the changes in the determined strengths of the signal of a specific sensor terminal in any one or combination of the following ways:

When the strength determined on one of the sides of the road decreases and the strength determined on the other side increases, the status of the traffic signal lamps is controlled to let a pedestrian pass;

When the strength determined on one of the sides of the road decreases and the strength determined on the other side decreases, the status of the traffic signal lamps is controlled according to a setting of the traffic signal lamps;

When the strength determined on one of the sides of the road increases and the strength determined on the other side increases, the status of the traffic signal lamps is controlled according to the setting of the traffic signal lamps; and When the strength determined on one of the sides of the road is stable and the strength determined on the other side is stable, the status of the traffic signal lamps is controlled according to the setting of the traffic signal lamps.

In an implementation, the apparatus can further includes:

An alarming module 503 configured to transmit a rapid passing alarm when the strength determined on one of the sides of the road decreases and the strength determined on the other side increases and the status of the traffic signal lamps is controlled to let the pedestrian pass.

In an implementation, the apparatus can further includes:

A location module 504 configured to determine location information of respective sensor terminals according to strengths and times of the respective sensor terminals and locations where the wireless signal is received.

For the convenience of a description, the respective components of the foregoing apparatuses have been described respectively by functionally dividing them into respective modules or units. Of course the functions of the respective modules or units can be performed in one or more softwares or hardwares to put the invention into practice.

As can be apparent from the foregoing embodiments, in the technical solutions according to the embodiments of the invention, sensor nodes with wireless mobile communication capability are installed on both sides of a vehicle road passed by a pedestrian, and the wireless sensor nodes can transmit received information relevant to a sensor terminal to an information processing module. The terminals which can be sensed at a short distance by the wireless sensor nodes (sensor terminals) can be distributed to a specific group of pedestrians (e.g., children, elderly men or women, etc.), and a sensing distance is at least above the distance between two wireless sensor nodes. The wireless sensor nodes can measure the strengths of signals of the sensor terminals and their changes. Input information of the information processing module includes a current status of traffic signal lamps and measurement information of the two wireless sensor nodes.

The information processing module can determine the location and passing status of the pedestrian according to the strength, measured by the two wireless sensor nodes, of the signal of a specific sensor terminal and a change tendency thereof.

If the information processing module determines that there is still a pedestrian carrying the sensor terminal and passing a vehicle road while a preset fixed passing time period is expiring during passing of the pedestrian in the traffic control system, then the passing time period can be controlled to be lengthen while transmitting an audible or optical alarm signal or combination thereof. The information processing module will not control the system to prohibit any pedestrian from walking until all the pedestrians carrying the sensor terminals pass the vehicle road safely.

Additionally if wireless sensor nodes are extensively deployed a traffic crossing and the relevant traffic control system is networked, then quasi real-time locating information of the sensor terminals can be provided by recording passing status and time of the sensor terminals and other information.

In the technical solutions according to the embodiments of the invention, wireless sensor nodes measure the strength of a signal of a sensor terminal, and an information processing module determines automatically a passing status of a pedestrian passing a road and adjusts signal lamps automatically to thereby ensure effectively the safety of the pedestrian under relevant intelligent control. Furthermore the foregoing traffic control system can further be networked to provide quasi real-time locating information of the sensor terminal.

Those skilled in the art shall appreciate that the embodiments of the invention can be embodied as a method, a system or a computer program product. Therefore the invention can be embodied in the form of an all-hardware embodiment, an all-software embodiment or an embodiment of software and hardware in combination. Furthermore the invention can be embodied in the form of a computer program product embodied in one or more computer useable storage mediums (including but not limited to a disk memory, a CD-ROM, an optical memory, etc.) in which computer useable program codes are contained.

The invention has been described in a flow chart and/or a block diagram of the method, the device (system) and the computer program product according to the embodiments of the invention. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable device provide steps for performing the functions specified in the flow(s) of the flow chart and/or the block(s) of the block diagram.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

The invention claimed is:

1. A traffic control system, comprising:

two wireless sensor nodes, respectively on both sides of a road, configured to determine the strengths of a wireless signal transmitted from a sensor terminal carried by a user upon obtaining the wireless signal transmitted from the sensor terminal and to notify an information processing module of the determined strengths; and the information processing module configured to determine changes in strength of the wireless signal according to the strengths of the wireless signal determined by the wireless sensor nodes, to detect the progress of the user and to control the status of traffic signal lamps according to the changes in strength.

2. The system according to claim 1, wherein the information processing module is further configured to control the status of the traffic signal lamps in any one or combination of the following ways:

when the strength determined by one of the wireless sensor nodes on both sides of the road decreases and the strength determined by the other wireless sensor node increases, the current status of the traffic signal lamps is maintained;

when the strength determined by one of the wireless sensor nodes on both sides of the road decreases and the strength determined by the other wireless sensor node decreases, the status of the traffic signal lamps is controlled according to a setting of the traffic signal lamps;

when the strength determined by one of the wireless sensor nodes on both sides of the road increases and the strength determined by the other wireless sensor node increases, the status of the traffic signal lamps is controlled according to the setting of the traffic signal lamps; and when the strength determined by one of the wireless sensor nodes on both sides of the road is stable and the strength determined by the other wireless sensor node is stable, the status of the traffic signal lamps is controlled according to the setting of the traffic signal lamps.

3. The system according to claim 2, further comprising:

an alarming module configured to transmit a rapid passing alarm when the strength determined by one of the wireless sensor nodes on both sides of the road decreases and the strength determined by the other wireless sensor node increases and the status of the traffic signal lamps is controlled to let the pedestrian pass.

4. The system according to claim 1, further comprising:

a locating server configured to determine location information of respective sensor terminals according to the received strengths and reception times of the respective sensor terminals and the wireless sensor nodes determining the sensor terminals; and the wireless sensor nodes are further configured to notify the locating server of determined sensor terminals and their strengths.

5. A control method of the traffic control system according to claim 1, comprising the steps of:

determining, by wireless sensor nodes respectively on both sides of a road, the strengths of a wireless signal transmitted from a sensor terminal when the sensor terminal transmits the wireless signal and notifying an information processing module of the determined strengths; and controlling, by the information processing module, the status of traffic signal lamps according to the changes in the strengths determined by the wireless sensor nodes.

6. The method according to claim 5, wherein the information processing module controls the status of the traffic signal lamps in any one or combination of the following ways:

when the strength determined by one of the wireless sensor nodes on both sides of the road decreases and the strength determined by the other wireless sensor node increases, the information processing module controls the status of the traffic signal lamps to let a pedestrian pass;

when the strength determined by one of the wireless sensor nodes on both sides of the road decreases and the strength determined by the other wireless sensor node decreases, the information processing module controls the status of the traffic signal lamps according to a setting of the traffic signal lamps;

when the strength determined by one of the wireless sensor nodes on both sides of the road increases and the strength determined by the other wireless sensor node increases, the information processing module controls the status of the traffic signal lamps according to the setting of the traffic signal lamps; and when the strength determined by one of the wireless sensor nodes on both sides of the road is stable and the strength determined by the other wireless sensor node is stable, the information processing module controls the status of the traffic signal lamps according to the setting of the traffic signal lamps.

7. The method according to claim 6, further comprising:

when the strength determined by one of the wireless sensor nodes decreases and the strength determined by the other wireless sensor node increases and the status of the traffic signal lamps is controlled to let the pedestrian pass, an alarming module transmitting a rapid passing alarm.

8. The method according to claim 5, further comprising:

notifying, by the wireless sensor nodes, a locating server of determined sensor terminals and their strengths; and determining, by the locating server, location information of the respective sensor terminals according to received strengths and reception times of the respective sensor terminals and the wireless sensor nodes determining the sensor terminals.

9. A traffic control method, comprising the steps of:

determining respectively on both sides of a road the strengths of a wireless signal transmitted from a sensor terminal carried by a user when the sensor terminal transmits the wireless signal; and detecting a progress of the user and controlling the status of traffic signal lamps according to the changes in the determined strengths.

10. The method according to claim 9, wherein the status of the traffic signal lamps is controlled according to the changes in the determined strengths in any one or combination of the following ways:

when the strength determined on one of the sides of the road decreases and the strength determined on the other side increases, the status of the traffic signal lamps is controlled to let a pedestrian pass;

when the strength determined on one of the sides of the road decreases and the strength determined on the other side decreases, the status of the traffic signal lamps is controlled according to a setting of the traffic signal lamps;

when the strength determined on one of the sides of the road increases and the strength determined on the other side increases, the status of the traffic signal lamps is controlled according to the setting of the traffic signal lamps; and when the strength determined on one of the sides of the road is stable and the strength determined on the other side is stable, the status of the traffic signal lamps is controlled according to the setting of the traffic signal lamps.

11. The method according to claim 10, wherein when the strength determined on one of the sides of the road decreases and the strength determined on the other side increases and the status of the traffic signal lamps is controlled to let the pedestrian pass, the method further comprises:

transmitting a rapid passing alarm.

12. The method according to claim 9, further comprising:

determining location information of respective sensor terminals according to strengths and times of the respective sensor terminals and locations where the wireless signal is received.

13. A traffic control apparatus, comprising:

an obtaining module configured to determine respectively on both sides of a road the strengths of a wireless signal transmitted from a sensor terminal carried by a user when the sensor terminal transmits the wireless signal; and the controlling module configured to detect a progress of the user and control the status of traffic signal lamps according to the changes in the determined strengths.

14. The apparatus according to claim 13, wherein the controlling module is further configured to control the status of the traffic signal lamps according to the changes in the determined strengths in any one or combination of the following ways:

when the strength determined on one of the sides of the road decreases and the strength determined on the other side increases, the status of the traffic signal lamps is controlled to let a pedestrian pass;

when the strength determined on one of the sides of the road decreases and the strength determined on the other side decreases, the status of the traffic signal lamps is controlled according to a setting of the traffic signal lamps;

when the strength determined on one of the sides of the road increases and the strength determined on the other side increases, the status of the traffic signal lamps is controlled according to the setting of the traffic signal lamps; and when the strength determined on one of the sides of the road is stable and the strength determined on the other side is stable, the status of the traffic signal lamps is controlled according to the setting of the traffic signal lamps.

15. The apparatus according to claim 14, further comprising:

an alarming module configured to transmit a rapid passing alarm when the strength determined on one of the sides of the road decreases and the strength determined on the other side increases and the status of the traffic signal lamps is controlled to let the pedestrian pass.

16. The apparatus according to claim 14, further comprising:

a location module configured to determine location information of respective sensor terminals according to strengths and times of the respective sensor terminals and locations where the wireless signal is received.

* * * * *